US006932778B2

(12) United States Patent
Hirt

(10) Patent No.: US 6,932,778 B2
(45) Date of Patent: Aug. 23, 2005

(54) MUSCULAR RELAXATION MACHINE FOR RELAXATION OF LEG MUSCLES

(76) Inventor: Jean-Claude Hirt, Ed, Lauredia, s/n. 5e 2$^{th}$ Av. De Sant Antoni, La Massana (AD), 1033

( * ) Notice: Subject to any disclaimer, the term of this patent is extended or adjusted under 35 U.S.C. 154(b) by 0 days.

(21) Appl. No.: 10/640,569

(22) Filed: Aug. 14, 2003

(65) Prior Publication Data

US 2004/0102724 A1 May 27, 2004

Related U.S. Application Data

(63) Continuation of application No. PCT/IB02/00465, filed on Feb. 11, 2002.

(30) Foreign Application Priority Data

Feb. 16, 2001 (ES) ..... 200100359

(51) Int. Cl.$^{7}$ ..... A61H 1/00

(52) U.S. Cl. ..... 601/35; 601/34; 601/29; 601/98; 601/101

(58) Field of Search ..... 601/23, 24, 26, 601/27, 29, 30, 32–35, 98, 101, 103, 104; 482/79

(56) References Cited

U.S. PATENT DOCUMENTS 2,255,066 A * 9/1941 Lamb ..... 601/29
2,949,911 A * 8/1960 Kennard et al. ..... 601/26
4,149,713 A * 4/1979 McLeod ..... 482/101
4,711,229 A 12/1987 Hengl
4,974,830 A * 12/1990 Genovese et al. ..... 601/29
5,148,800 A * 9/1992 Pecheux ..... 601/29
5,254,060 A 10/1993 Bohanan ..... 482/60
5,399,147 A * 3/1995 Kaiser ..... 601/34
5,529,560 A * 6/1996 Davies et al. ..... 482/131
6,572,568 B2 * 6/2003 Huang ..... 601/29

FOREIGN PATENT DOCUMENTS

ES 2190724 8/2003
FR 2632867 12/1989

* cited by examiner

*Primary Examiner*—Danton DeMille
(74) *Attorney, Agent, or Firm*—Jacobson Holman PLLC

(57) ABSTRACT

A pair of supports for the legs of the user. The supports being movable so that they approach and move away from each other, and the supports being associated with a driving device. The supports are padded and mounted on a height-adjustable plate The driving device includes a motor, the shaft of which is associated with the supports by a pair of connecting rods or a connecting rod and crank mechanism, so that operation of the motor causes joint movement of the supports, which move away from and approach each other alternately. This permits a relaxation movement to be carried out without the intervention of any person.

10 Claims, 4 Drawing Sheets

MUSCULAR RELAXATION MACHINE FOR RELAXATION OF LEG MUSCLES

This is a continuation of PCT/IB02/00465 filed Feb. 11, 2002 and published in English.

FIELD OF THE INVENTION

This invention relates to a muscular relaxation machine which achieves relaxation of the musculature of the legs.

BACKGROUND

It is very usual to see masseurs/euses carrying out massages on professional sportsmen/women in order to avoid muscle injuries when the latter have to make a prolonged effort.

A massage of this type consists in holding the legs by the ankles and moving the legs energetically together and apart, in such a way that the muscles move and relax.

This technique has the disadvantage of being excessively tiring, so that it can only be carried out by a person for a relatively short period of time.

FR2632867 discloses a versatile device which makes it possible, on the one hand, to carry out a scissor movements of the legs and, on the other hand, as a complement, a to-and-fro movement. The device comprises a support platform provided with elevation means supporting another platform equipped with means for fastening sideways guiding slides on which pivoting heelpieces are fastened. Each slide-heelpiece assembly is coupled via connecting rods to at least one gear-motor group located between slideways so that the slides driven by the gear-motor group, causes the closing together and separation of the legs in an horizontal or inclined plane, upwards or downwards.

U.S. Patent No. 4,711,229 discloses a massaging apparatus for the lower extremities of the body, comprising means to produce a massaging perpendicular to the axis of the legs in a radial and oscillating motion, i.e. to induce an oscillation corresponding to the arc of a circle, and longitudinally to the axis of the legs.

SUMMARY OF THE INVENTION

None of these prior art devices provide means adapted to massaging the lower extremities of the body while supported on the knees adapted to each user and with the supports of the end parts of the legs adapted to rotate around a horizontal shaft so that its position can be changed.

A first objective of this invention therefore consists in achieving a machine which carries out this type of massage automatically, without the intervention of a person.

The machine of this invention manages to resolve the aforesaid disadvantages, while providing other advantages which will be described below.

DESCRIPTION Of THE INVENTION

The muscular relaxation machine of this invention is characterised in that it includes a pair of supports for the legs of the user, said supports being movable so that they approach and move away from each other, and said supports being associated with driving means.

Thanks to this characteristic, relaxation of the legs of the user can be carried out without the intervention of any specialist, thus achieving an improved relaxing action.

In order to be able to adjust to the needs of the user and achieve maximum comfort in the machine of this invention, said supports are mounted on a height-adjustable plate and can also be rotatable around a vertical shaft, as well as being padded.

According to a first embodiment, said driving means comprise a motor, with the shaft of which the supports are associated by means of connecting rods, so that the operation of the motor causes joint movement of the supports, moving apart from and approaching each other, alternately.

According to a second embodiment, said driving means comprise a motor associated with a connecting rod and crank mechanism, with the end of said connecting rod being linked with one of the supports, and with said driving means also including means of transmitting the movement from one support to the other.

Preferably, said means of transmission of the movement of one support to the other includes a belt.

Advantageously, said supports are al so rotatable around a horizontal shaft.

Also advantageously, the machine of this invention further includes means for altering the point of oscillation between the connecting rod and the crank.

BRIEF DESCRIPTION OF THE FIGURES

For a better understanding of all that has been described in this specification, some drawings are attached which, solely by way of example, show a practical case of embodiment of the muscular relaxation machine of this invention.

In said drawings.

DESCRIPTION OF A PREFERRED EMBODIMENT

Figure 1:
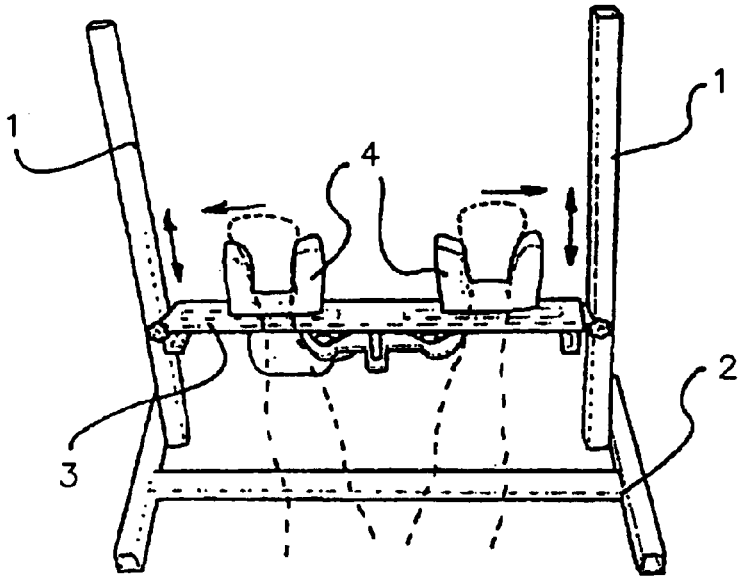
FIG. 1 is a perspective view of the machine of this invention according to a first embodiment, with the supports placed in a separated position.

As can be appreciated in FIG. 1, the muscular relaxation machine of this invention includes a pair of vertical bars 1 attached to the chassis 2 of the machine.

Between said vertical bars 1 is fitted a plate 3 whose height can be adjusted. Although setting of the position of this plate 3 can be carried out in any suitable manner, in the embodiment shown this is done by means of a pair of knobs situated on the ends of the plate 3.

The machine of this invention also includes a pair of supports 4 for the legs of the user. These supports 4 can be moved along two slots provided in the plate 3, so that they carry out an alternating movement of approaching and moving away from each other.

In order to permit maximum comfort of the user of the machine of this invention, said supports 4 are made of a padded material and can rotate around a vertical shaft 11.

The movement of said supports 4 can be driven in any suitable manner. However, FIGS. 3 and 4 show two alternative embodiments of the driving means of the supports 4.

Figure 3:
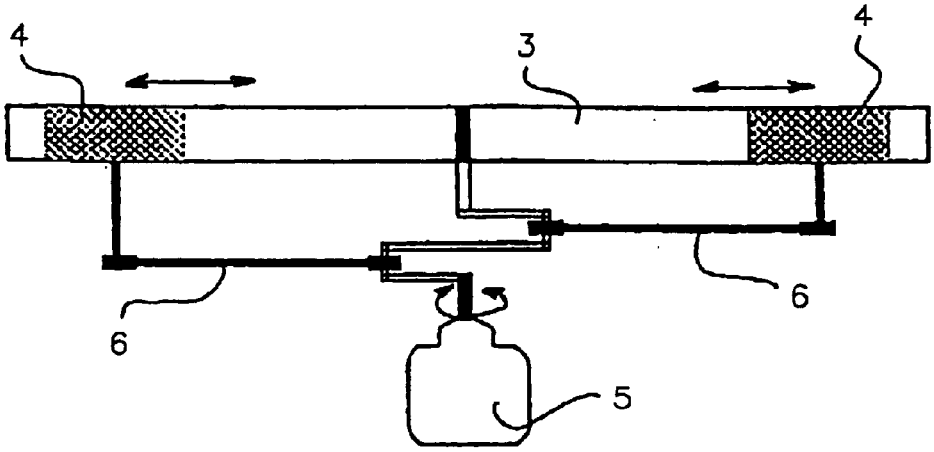
FIG. 3 is a schematic plan view of the means of driving the movement of said supports according to a first embodiment.

In accordance with the embodiment shown in FIG. 3, these driving means include a motor 5, with the shaft of which are associated a pair of connecting rods 6, one for each support 4. Rotation of the motor shaft 5 thus leads to alternating movement of the supports approaching and moving away from each other.

Figure 4:
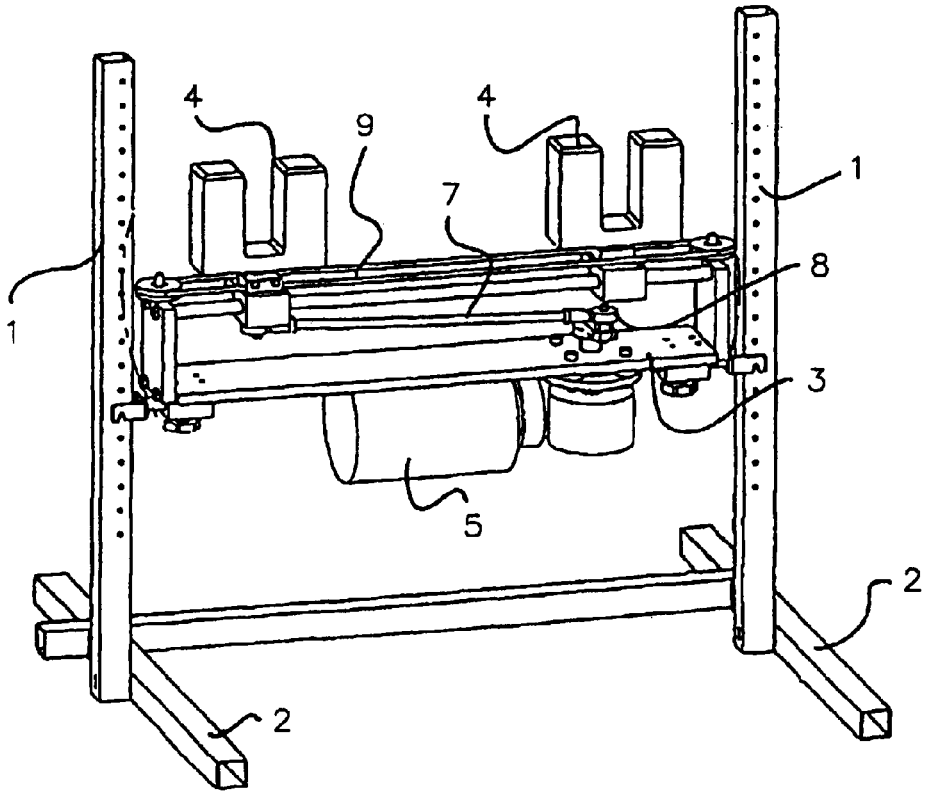
FIG. 4 is a perspective view of a machine according to another embodiment of the invention, with the supports in an upright position.
Figure 5:
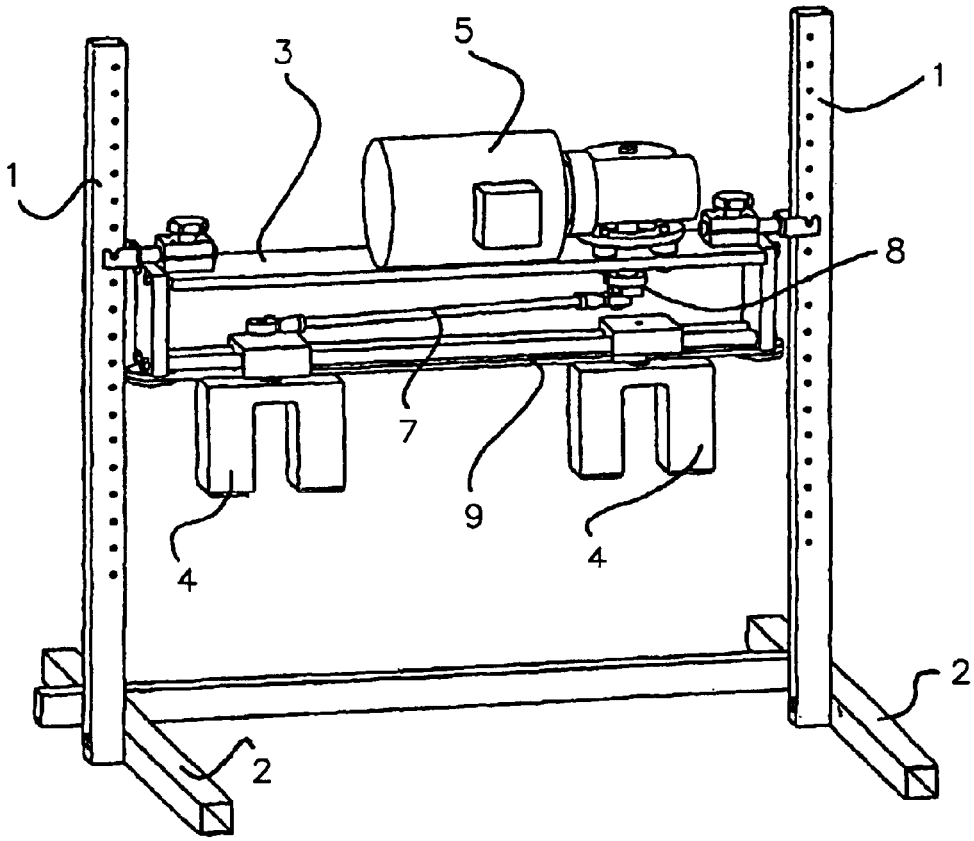
FIG. 5 is a perspective view of the machine of this invention according to the embodiment shown in FIG. 4, with the supports rotated through 180° with respect to the position of the previous figure.

According to the embodiment shown in FIGS. 4 and 5, the driving means include a motor 5 associated with a connecting rod 8 and crank mechanism. The end of said connecting rod 7 is linked to one of the supports 4, with said driving means also including a belt 9 which transmits the movement from one support 4 to the other to move the supports to approach and move away from each other along aligned paths as shown by arrows 14, 14 and 16, 16.

Figure 2:
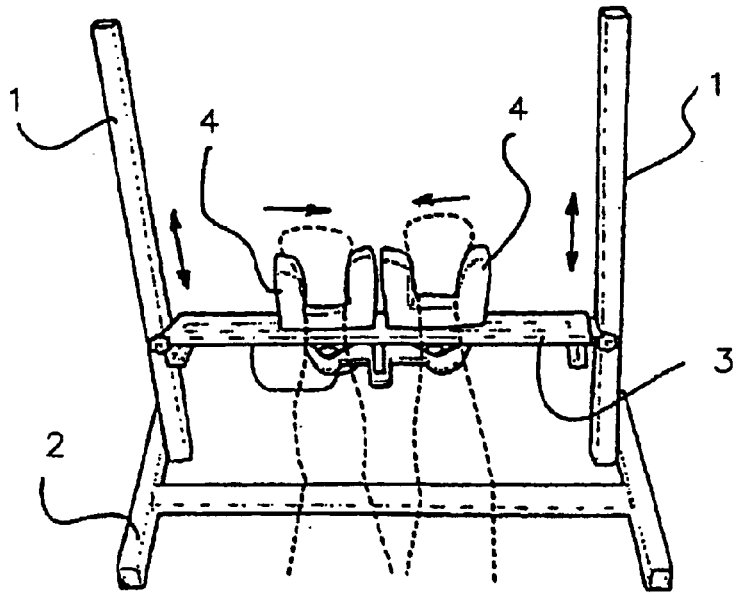
FIG. 2 is a perspective view of the machine of this invention according to a first embodiment, with the supports beside one another.

The position of the supports 4 can also be changed to the position shown in FIG. 5 in the direction of arrows 18, 18 and 20, 20 (shown in FIG. 2), by rotating the supports around a horizontal shaft 12 extending parallel to the aligned paths of the supports shown by arrows 14, 14 and 16, 16. In this position, the supports 4 are used for the knees.

If so wished, the point of oscillation between the connecting rod 7 and the crank 8 can be altered, thereby regulating the stroke of the oscillatory movement of the supports 4 along aligned oaths shown by arrows 14, 14 and 16, 16. Alteration of the point of oscillation is implemented through a number of orifices (not shown) provided along the length of the crank 8, with the end of the connecting rod attached into one of these orifices.

Figure 6:
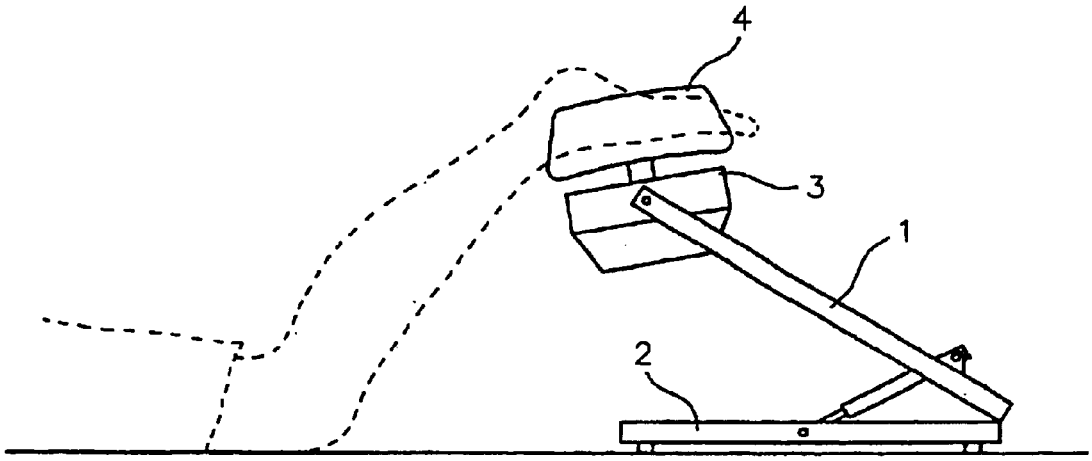
FIGS. 6 and 7 are side elevation views of the machine of this invention according to another embodiment in two different positions adapted to massage the legs of a user while he or she is lying on his or her stomach or on his or her back, respectively.
Figure 7:
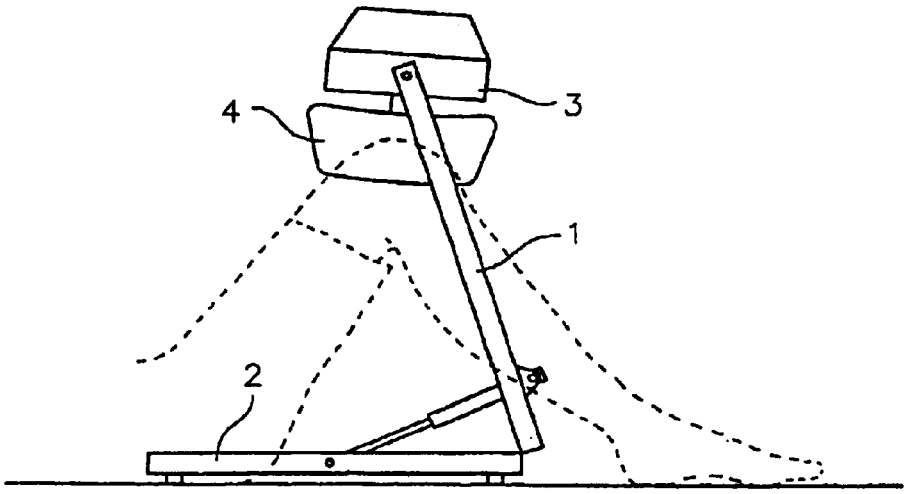

FIGS. 6 and 7 shows the machine of this invention according to an alternate embodiment wherein bars 1 are hinged so as to pivot about the chassis 2 and setting means are provided to set the bars 1 in a desired angle with respect to chassis 2. Plate 3 is fitted between the bars 1 and the driving means are enclosed in a housing attached to plate 3.

With the machine of this invention it is very simple to implement the desired relaxation movement. To that end, the user of the machine must first stretch out on the floor and place the feet on said supports 4. The user or the person supervising the relaxation movement then sets the height of the plate 3 so that the user obtains the maximum comfort, which can also be achieved thanks to the rotatory movement of the supports 4.

A massaging position where the user is lying on his or her stomach with his or her insteps on supports 4 is shown in FIG. 6. Another alternative massaging position is shown in FIG. 7, wherein the user is laying on his or her back and the supports 4 are in the inverted position shown in FIG. 5 to fit the user's knees after rotation about horizontal axis 12. In still another alternative massaging position (not shown) the user is laying on his or her back with his or her heels on the supports 4, which are in the upright position. Other massaging positions not shown are possible.

Once in this position, the motor 5 will simply have to be run so that the supports 4 carry out the aforesaid movement, leading to relaxation of the legs of the user.

As is obvious, the motor can have control means associated with it in order to regulate, for example, the speed of movement of the supports 4 or the duration of said movement.

Despite the fact that reference has been made to a specific embodiment of the invention, it will be obvious to an expert in the subject that the muscular relaxation machine described allows of many variations and modifications, and that all the details mentioned may be replaced by others that are technically equivalent, without departing from the sphere of protection defined in the attached claims.

What is claimed is:

1. Muscular relaxation machine for relaxation of the leg muscles, said muscular relaxation machine comprising:

a pair of supports for the legs of the user, a driving device for said supports for moving the supports to approach and move away from each other; and a height-adjustable plate upholding said pair of supports;

said driving device allowing movements of said pair of supports along aligned paths, the supports also being rotatable around a horizontal axis extending parallel to the aligned paths so that the supports are placed in different positions by rotating the supports about said horizontal axis to achieve a maximum comfort for the user and several massaging positions for the legs and knees.

2. Muscular relaxation machine according to claim 1, wherein said supports move horizontally along slots provided in said plate.

3. Muscular relaxation machine according to claim 1, wherein said height-adjustable plate is rotatable together with said pair of supports around said horizontal axis and can be fixed in a desired position.

4. Muscular relaxation machine according to claim 1, wherein each of said supports is rotatable around a vertical axis.

5. Muscular relaxation machine according to claim 1, wherein said supports are padded.

6. Muscular relaxation machine according to claim 1, wherein said driving device comprises:

a motor; and a crankshaft attached to a driving axis of said motor; wherein each of said supports is connected to said crankshaft by a connecting rod, so that operation of the motor causes joint movement of the supports which approach and move away from each other.

7. Muscular relaxation machine according to claim 1, wherein said driving device comprises:

a motor;

a connecting rod and a crank mechanism associated with said motor; and a belt for transmitting movement from one support to the other, wherein the end of said connecting rod is linked with one of the supports.

8. Muscular relaxation machine according to claim 7, wherein said crank controls regulation of a stroke of approach and move away movement of said supports.

9. Muscular relaxation machine according to claim 7, wherein said supports receive end parts of said legs while said supports are supported on the ground or a support plane by the knees.

10. Muscular relaxation machine according to claim 1, wherein said pair of supports are rotatable at least 180 degrees around said horizontal axis to attain said several massaging positions, including an upright position and an inverted position.

* * * * *